US007322544B2

(12) United States Patent
Collins

(10) Patent No.: US 7,322,544 B2
(45) Date of Patent: Jan. 29, 2008

(54) DECORATIVE COVER FOR DISPENSING AND AT LEAST PARTIALLY CONCEALING A ROLL OF A FLEXIBLE SHEET MATERIAL

(76) Inventor: Bonnie Collins, 1598 Mears Ave., Cincinnati, OH (US) 45230

( * ) Notice: Subject to any disclaimer, the term of this patent is extended or adjusted under 35 U.S.C. 154(b) by 95 days.

(21) Appl. No.: 11/248,489

(22) Filed: Oct. 12, 2005

(65) Prior Publication Data

US 2007/0080256 A1 Apr. 12, 2007

(51) Int. Cl.
*B65H 75/18* (2006.01)

(52) U.S. Cl. ..... 242/598.5; D6/523

(58) Field of Classification Search ..... 242/598.3, 242/598.5, 598.6, 598, 596.8; D6/518, 519, D6/523

See application file for complete search history.

(56) References Cited

U.S. PATENT DOCUMENTS 1,588,577 A 6/1926 Heifler
1,609,862 A * 12/1926 Clifford
2,327,816 A 8/1943 Olson
2,462,776 A 2/1949 Price
2,606,724 A 8/1952 Hertz
2,737,353 A 3/1956 Banks, Jr.
2,858,994 A 11/1958 Sarro
2,908,450 A * 10/1959 Stone
3,073,541 A 1/1963 Layton et al.
3,413,049 A 11/1968 Smay ..... 312/39
3,843,071 A 10/1974 Graham
D247,465 S * 3/1978 Ford ..... D6/523
4,089,481 A 5/1978 Ciuci
4,721,264 A * 1/1988 Muscarello
4,739,943 A * 4/1988 Geller
4,804,149 A * 2/1989 Murphy ..... 242/598.3
D308,445 S * 6/1990 Loughridge ..... D6/518
D311,106 S * 10/1990 Jaber
5,170,958 A * 12/1992 Brown
5,680,978 A * 10/1997 Pinion
5,697,577 A 12/1997 Ogden

* cited by examiner

*Primary Examiner*—William A Rivera
(74) *Attorney, Agent, or Firm*—Wood, Herron & Evans, LLP

(57) ABSTRACT

A decorative cover for containing a roll of a flexible sheet material, such as a paper web product, and dispensing lengths of the flexible sheet material from the roll. The decorative cover includes a tubular sidewall with opposite open ends through either of which the roll may be inserted into an at least partially concealed position within the sidewall and a longitudinal slot through which the paper web product may be dispensed from the roll when the roll is positioned in the at least partially concealed position.

18 Claims, 3 Drawing Sheets

DECORATIVE COVER FOR DISPENSING AND AT LEAST PARTIALLY CONCEALING A ROLL OF A FLEXIBLE SHEET MATERIAL

FIELD OF THE INVENTION

The present invention generally relates to decorative covers for dispensing lengths of a flexible sheet material, such as a paper web product like toilet tissue, wound on a roll.

BACKGROUND OF THE INVENTION

Household and commercial paper web products, such as toilet tissue and paper towels, are supplied as a flexible sheet material wound about a central core in the form of a tubular roll. For dispensing, the core of the tubular roll is mounted on a spindle about which the roll rotates when a force is applied to the terminal end of the sheet material. Upon dispensing, segments or lengths of the paper web product are separated from the remainder of the roll by tearing or cutting facilitated by the dispenser and/or the user. Most paper web products include multiple sheets or segments with adjacent segments joined along perforated lines.

When mounted on a wall bracket, a roll of a paper web product is exposed and visible to the user. The immediate visibility of the rolled paper web product may be aesthetically unpleasing to the user. Decorative covers are commonly available for other objects found in a household or commercial bathroom. For example, pasteboard facial tissue boxes are commonly covered to conceal the box, yet permit the interfolded or C-folded facial tissues to be removed from a stack of such tissues through an opening in the cover. Decorative covers for the facial tissue box are commonly provided and/or used with other color and/or pattern coordinated accessories, such as a liquid soap dispenser. However, a comparable cover of a simple construction is not available for rolled web products like toilet tissue. Conventional dispensers that are available for rolled paper web products, in addition to having an appearance that is not aesthetically pleasing, have multiple moving parts, such as rollers and hand-operated cranks or turning knobs that permit a user to rotate the spindle upon which the rolled paper web product is disposed.

For these and other reasons, it would be desirable to provide a decorative cover for a roll of a paper web product that has a mechanically simple construction and an aesthetically pleasing appearance.

SUMMARY OF INVENTION

In accordance with an embodiment of the invention, a cover for a roll of a paper web product comprises a shell having a tubular sidewall extending between a first open end surrounded by a first rim and a second open end surrounded by a second rim. Each of the first and second open ends is unoccluded for moving the roll of the paper web product into an at least partially concealed position inside the tubular sidewall. Defined in the tubular sidewall is a longitudinal slot that extends generally between the first and second open ends. The longitudinal slot permits access to the at least partially concealed position inside the tubular sidewall and, hence, is beneficial for dispensing segments of the paper web product. The longitudinal slot is bounded by a first edge separated from the first rim by a first portion of the sidewall and a second edge separated from the second rim by a second portion of the sidewall.

The decorative cover of the invention is easy to refill by simply removing the cover from the spindle, removing the spent core, installing a fresh roll of the paper product on the spindle, placing the cover on the fresh roll and spindle, and reinstalling the spindle on the wall support or bracket. Installation of the decorative cover on the bracket requires no tools and no fasteners. The roll of web product may be easily inserted through either of the open ends of the tubular housing without the need to remove a cap or other closure. The lack of a closure, cap or fixed wall at either open end of the tubular housing eliminates right angle corners that might otherwise be difficult to clean or sanitize and that might otherwise accumulate dirt or bacteria. The open bore between the open ends is readily accessible for cleaning. Preferably, the geometrical shape of the tubular housing conforms closely to the shape of commercially available cylindrical rolled web products.

Advantageously, the slot through which segments of the rolled web product are dispensed does not extend the full length of the tubular housing. Instead, the slot is bounded by margins or strips of solid material that limit the slot width. The slot may be dimensioned such that the user can physically touch the roll of web product for threading the end of the web product through the slot. As a result, the end of the web product may be easily retrievable if its slips inside. The decorative cover may be dimensioned to receive rolls having various different outer diameters.

The decorative cover of the invention has a simple design and, as a result, is relatively inexpensive to produce. The decorative cover of the invention operates without the assistance of any moving parts and, as a consequence, does not include moving parts susceptible to wear and breakage. The decorative cover of the invention has a single piece, unitary construction. The decorative cover of the invention may be constructed from many types of materials, including but not limited to polymers and brushed metals.

These and other advantages of the present invention shall become more apparent from the accompanying drawings and description thereof.

BRIEF DESCRIPTION OF DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
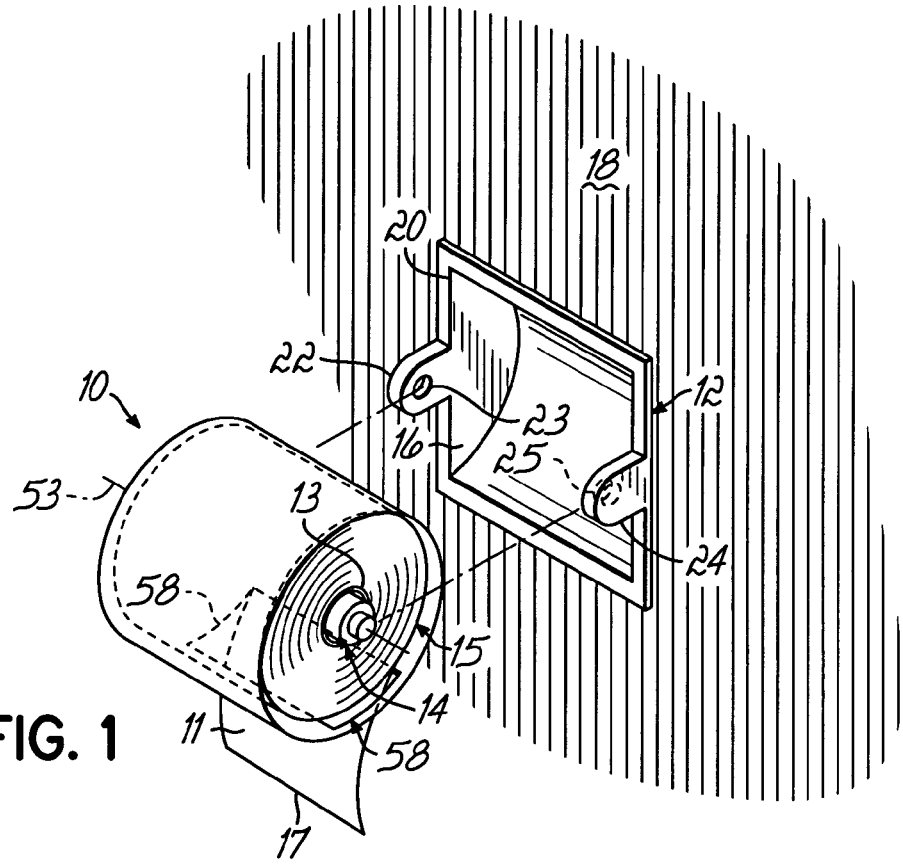
FIG. 1 is a disassembled perspective view of a cover for a roll of a paper web product in which the cover is constructed in accordance with an embodiment of the invention.

With reference to FIG. 1, a decorative cover 10 of the present invention is adapted to cooperate with a conventional wall bracket 12 and a spindle 14 for mounting a roll 15 of a paper web product 11, such as toilet paper. Roll 15 comprises multiple flat, thin sheets or segments of the paper web product 11 that may be joined by perforated lines. The paper web product 11 is wound in a wrapped, rolled arrangement about the curved exterior of a cylindrical hollow core 13. The hollow core 13 is rotatably supported on the spindle 14 for incrementally unrolling the paper web product 11 from the roll 15 to dispense successive lengths of the paper web product 11. Each successive length consists of one or more segments of the paper web product 11. The paper web product 11 carried by roll 15 includes a leading end 17 that is accessible to a user from the exterior of the cover 10 through slot 58, as further described below, and a trailing end (not shown) that is often affixed by, for example, adhesive bonding to the curved exterior of the hollow core 13. As segments of the paper web product 11 are successively removed, the leading end 17 is defined by the first segment remaining on the roll 15.

Figure 1A:
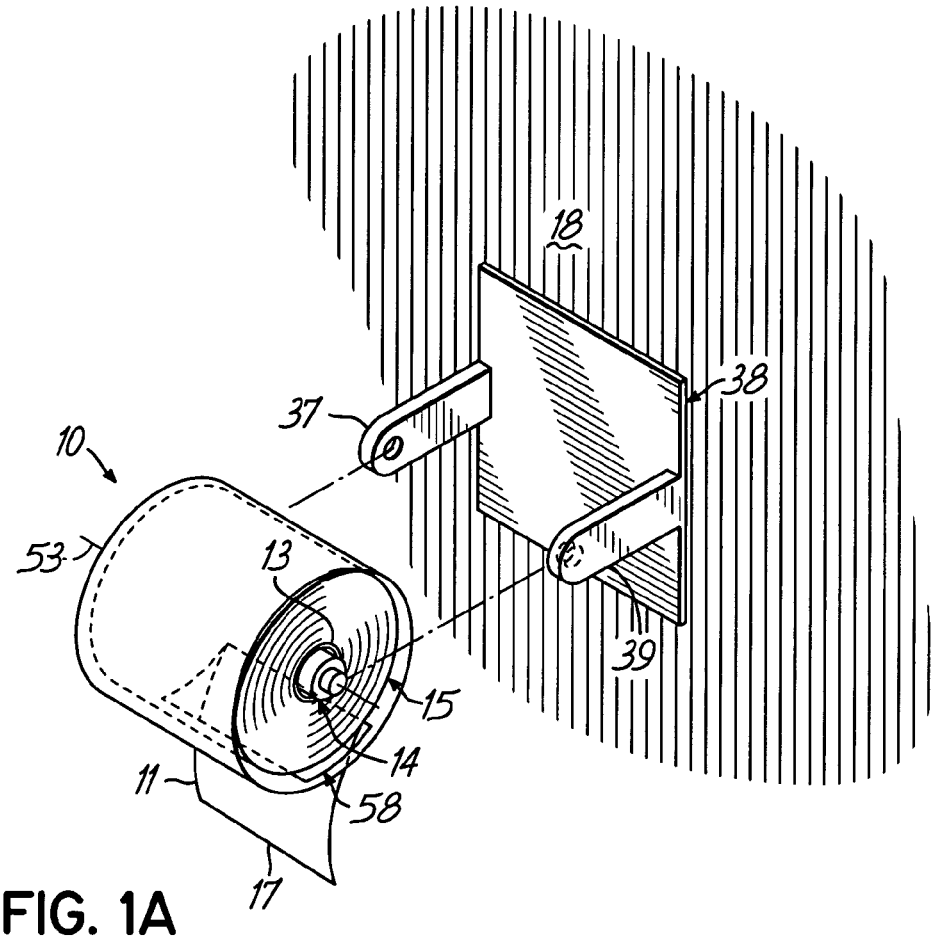
FIG. 1A is a disassembled perspective view of the cover of FIG. 1 as used in conjunction with a different type of support mount.

The wall bracket 12 includes a concave portion 16 that is at least partially recessed into a wall 18 and a rim 20 surrounding the concave portion 16. Projecting outwardly from the rim 20 is a pair of spaced-apart arms 22, 24, which are separated by a distance sufficient to receive the cover 10 and roll 15. Each of the arms 22, 24 includes a corresponding one of a pair of depressions or concavities 23, 25, respectively. The concavities 23, 25 are positioned and arranged on the arms 22, 24 to have a confronting relationship. The cover 10 may be used with other types of wall brackets, such as wall bracket 38 shown in FIG. 1A that is not recessed into the plane of the wall 18. The bracket 38 includes two spaced-apart arms 37, 39 that serve a similar function as arms 22, 24 (FIG. 1).

Figure 2:
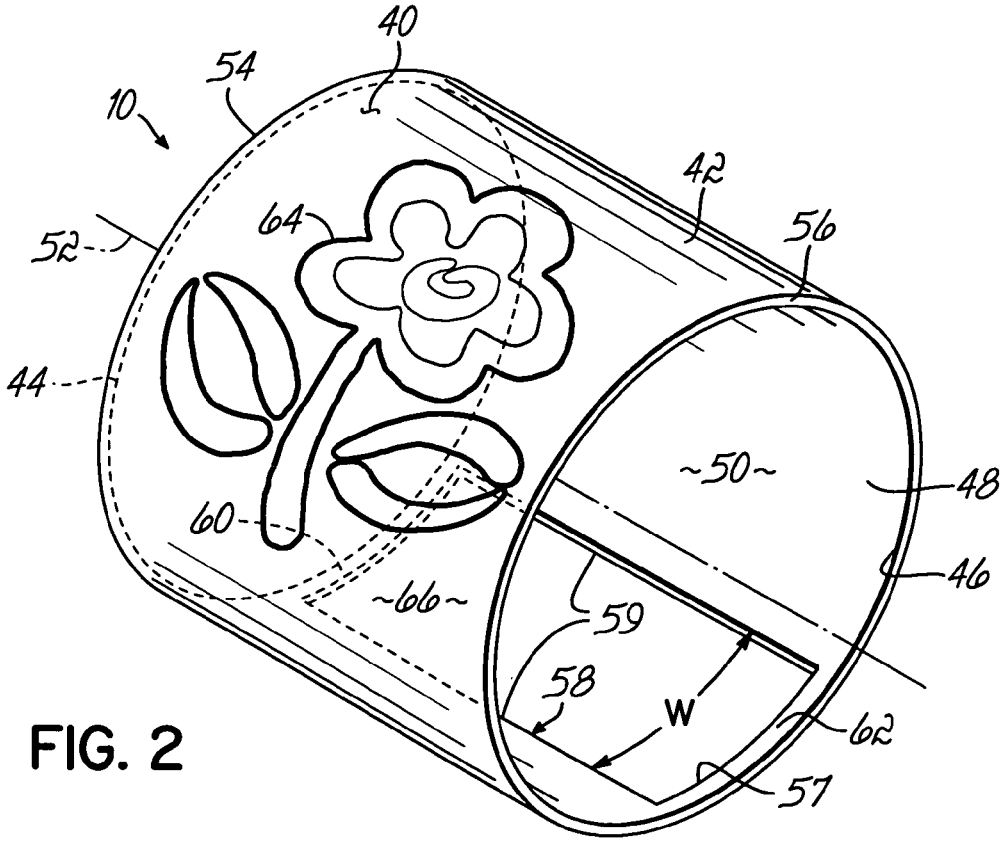
FIG. 2 is a perspective view of the cover of FIG. 1.
Figure 3:
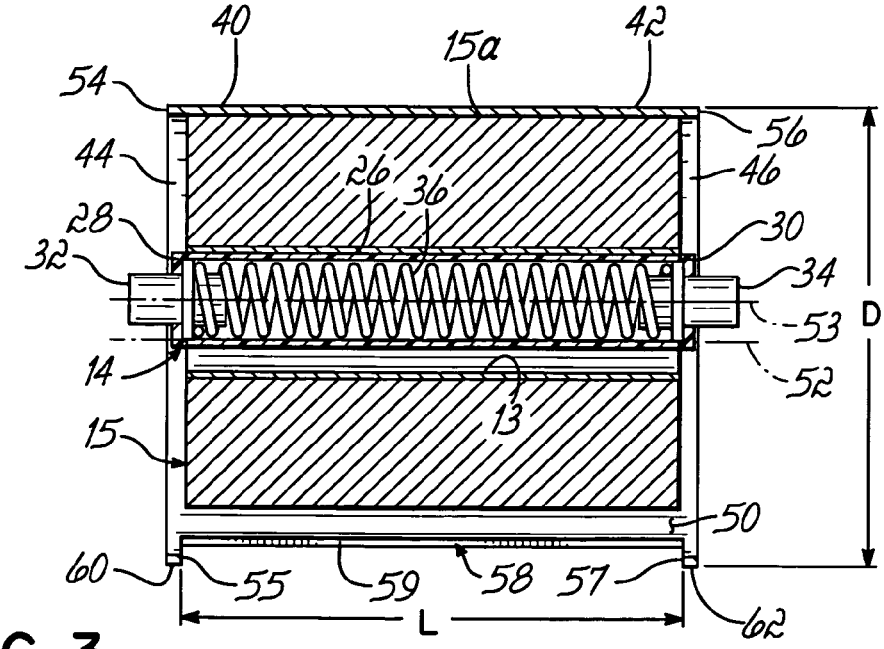
FIG. 3 is a longitudinal cross-sectional view of the cover of FIG. 1 depicted separated from the wall bracket for clarity.

With reference to FIGS. 2 and 3, the spindle 14 has a tubular central shaft 26 with opposite open ends 28, 30, a captivated button 32 projecting from one open end 28, another button 34 projecting from an opposite open end 30, and a spring 36 confined inside the interior of the central shaft 26. The spring 36 is captured in a compressed state between the buttons 32, 34 and spring biases the buttons 32, 34 outwardly in opposite longitudinal directions from the central shaft 26. The buttons 32, 34 are dimensioned and geometrically shaped to conform to the concavities 23, 25 (FIG. 1) such that the buttons 32, 34 are engaged with the concavities 23, 25 for securing the spindle 14 with the wall bracket 12 (FIG. 1). The cover 10 and roll 15 are suspended from the spindle 14 when the spindle 14 is coupled with the wall bracket 12.

The cover 10 comprises a thin-walled tubular shell 40 having a tubular sidewall 42 that extends between a first open end 44 and a second open end 46, which is spaced apart from open end 44 along a longitudinal axis 52. The open ends 44, 46 are not occluded by any fixed or removable structure, such as a cap, a closure, a cover, or an end wall, that would prevent the passage of the roll 15 in a direction generally parallel to the longitudinal axis 52. During use, the open ends 44, 46 remain unoccluded and are not closed or otherwise obstructed.

The tubular sidewall 42 includes a curved interior surface 50 that surrounds and bounds a cavity 48. The cavity 48 is dimensioned and shaped geometrically to receive the roll 15 when roll 15 is positioned in an operative position inside the cover 10. When roll 15 is positioned inside cavity 48, the paper web product 11 may be completely concealed or partially concealed from view but, in any event, at least a portion of the paper web product 11 is concealed from view.

The tubular sidewall 42 is preferably centered about the longitudinal axis 52 that extends between the open ends 44, 46. The longitudinal axis 52 of the tubular sidewall 42 does not coincide with a longitudinal axis 53 of the spindle 14 and, when paper web product 11 is not being dispensed, is offset vertically from longitudinal axis 53. The non-coincidence of the longitudinal axes 52, 53 becomes more pronounced as the paper web product 11 is dispensed from roll 15.

Open end 44 is surrounded by a rim 54 defining one lateral edge of the sidewall 42 and open end 46 is surrounded by a rim 56 defining another lateral edge of the sidewall 42. The inner diameter, D, of each of the rims 54, 56 and, hence, open ends 44, 46 is selected to permit the roll 15 to be freely inserted through either of the open ends 44, 46, respectively. The rims 54, 56 do not contact the spindle 14 nor do the rims 54, 56 rely upon the spindle 14 for any type of motion guidance during rotation of roll 15 to remove paper web product 11. The rims 54, 56 may optionally include short radially-projecting, circumferential flanges (not shown) that do not occlude the open ends 44, 46 to prevent or restrict the movement and passage of the roll 15 in a direction generally along axis 52 into and out of its at least partially concealed position inside the sidewall 42.

In one embodiment of the present invention, open ends 44, 46 may be centered about the longitudinal axis 52 and the inner diameter of the tubular sidewall 42 at any position along longitudinal axis 52 between the open ends 44, 46 may be approximately equal to the inner diameter of the rims 54, 56. Hence, in this specific embodiment, the tubular shell 42 is shaped as a right circular cylinder with an altitude measured along the longitudinal axis 52 and a radius normal to the altitude.

Perforating the sidewall 42 between the interior surface 50 and an exterior surface 66 is a longitudinal opening or slot 58 framed and surrounded by a rim 59. The slot 58 and rim 59 extends with a major dimension, L, and an arcuate minor dimension, W, extending circumferentially along an arc and generally perpendicular to the major axis. The major dimension may extend along the longitudinal axis 52. The longitudinal slot 58 is curved and arcuate along peripheral edges 55, 57 and may be considered to be rectangular with the major dimension of the rim 59 representing the largest rectangular dimension of the slot 58. The minor dimension of the longitudinal slot 58, which may be evaluated as a distance along the arced edge of the cutout in sidewall 42, is considerably greater than the thickness of the paper web product 11 so that the leading end 17 can pass easily out of the cover 10 through the slot 58 without breaking or tearing.

The longitudinal slot 58 does not extend in a lateral direction completely to either of the rims 54, 56 but, instead, has a length that is less than or shorter than the length of the sidewall 42. As a result, the longitudinal slot 58 is advantageously bounded at opposite peripheral edges 55, 57 by one of a pair of strips or margins 60, 62, respectively, that represent material of the sidewall 42. The margins 60, 62 constitute integral portions of the sidewall 42 and, hence, are composed of the material of the sidewall 42. The rims 54, 56 surrounding the open ends 44, 46, respectively, are unbroken because the longitudinal slot 58 does not extend through the tubular sidewall 42 to intersect with either rim 54 or rim 56.

Margin 60 separates rim 54, which encircles opening open end 44, from the peripheral edge 55 of the rim 59 of longitudinal slot 58. Similarly, margin 62 separates rim 56, which encircles opening open end 46, from the peripheral edge 57 of the rim 59 of longitudinal slot 58. The distance between rim 54 and edge 55 determines the width of margin 60 and, similarly, the distance between rim 56 and edge 57 determines the width of margin 62. Typically, the margins 60, 62 have equal widths so that, when the roll 15 is mounted on spindle 14, the roll 15 is nominally positioned symmetrically between the rims 54, 56.

The margins 60, 62 confine the paper web product 11 to the boundary of the longitudinal slot 58 during use and make the sidewall 42 continuous. The longitudinal slot 58 extends for a distance at least equal to a width of the paper web product 11 on roll 15 and affords an exit for extracting the leading end 17 of the paper web product 11 for unrolling sheets of the paper web product 11. The size of longitudinal slot 58 is selected such that a person can extend one or more fingers through the slot 58 for grasping the leading end 17 of the paper web product 11 and threading the leading end 17 through the slot 58 to expose the leading end 17.

In a specific embodiment of the invention, the tubular shell 40 is annular or ring-shaped in cross-section from a perspective along the longitudinal axis 52 and has an inner diameter equal to about 4 inches and a length equal to about 5 inches and the longitudinal slot 58 is about 2 inches wide (i.e., minor dimension) by about 4½ inches long (i.e., major dimension) such that the margins or strips 60, 62 on each side of the slot 58 measure about ¼ inch wide. The length of the tubular shell 40 is measured along the longitudinal axis 52 between the rims 54, 56. At least one and, preferably, both of the rims 54, 56 has a diameter equal to the inner diameter of the tubular shell 40. The thickness of the tubular sidewall 42 is selected to impart a sufficient stiffness to the cover 10 such that the tubular shell 40 does not deform during use. In another specific embodiment, the tubular shell 40 has a length equal to about 5½ inches and a diameter equal to about 4¾ inches, and the strips 60, 62 are about ½ inch wide with slot 58 being about 2 inches wide by about 4½ inches long. This latter set of dimensions advantageously permits the cover 10 to be used with single rolls 15 and the larger double rolls 15 of paper web product 11 that are currently commercially available.

The cover 10 may be manufactured by a molding process, such as injection molding, from various colored thermoplastic materials in various degrees of transparency, translucency, or opacity to provide an aesthetically pleasing appearance. Preferably, the cover 10 is formed from a translucent or opaque material such that light transmission through the tubular sidewall 42 is restricted or prevented to obscure the roll 15 or prevented to conceal the roll 15. Most preferably, the tubular shell 40 is opaque or highly translucent such that the roll 15 is not visible to the user through the sidewall 42. If the material forming the cover 10 is transparent or translucent, a user can verify the amount of paper web product 11 remaining on the roll 15 without the necessity of removing the cover 10.

A wide array of commercially available polymers may be used to form the cover 10, such as polypropylene, polystyrene, and polyethylene. Alternatively, the decorative cover 10 may be formed from a metal sheet, which may have a brushed finish or a polished finish, using metalworking techniques familiar to persons having ordinary skill in the art. Other suitable materials may include wood or ceramics. Preferably, the tubular shell 40 is formed from a polymer such that the cover 10 is lightweight.

The exterior surface 66 of the tubular shell 40 may include a decorative finish 64, which may take the form of a figure or pattern, that adds to the aesthetic appearance of the decorative cover 10. The decorative pattern 64 may be applied as an applique or laminate to the exterior surface 66 or may be printed directly on the exterior surface 66. A sleeve (not shown) may be attached to the exterior surface 66 such that a sheet (not shown) bearing the decorative figure or pattern 64 may be inserted between the sleeve and the exterior surface 66 such that the pattern 64 is visible to the user. This inserted sheet may be changed or customized by the user according to personal preference.

With reference to FIGS. 1-3 and 3A and in use, the spindle 14 is manipulated to release the buttons 32, 34 from the concavities 23, 25 and the spindle 14 and cover 10 are separated from the wall bracket 12 to replace a spent roll for replenishing the supply of paper web product 11. The cover 10 and the spindle 14 are separated. The spent core 13 is removed from the spindle 14 and a fresh roll 15 of the paper web product 11 is placed on the spindle 14. The fresh roll 15 is inserted through one of the open ends 44, 46 of the tubular sidewall 42. The cover 10, fresh roll 15, and spindle 14 are maneuvered to a position between the arms 22, 24 with the buttons 32, 34 depressed inside of shaft 26. The released buttons 32, 34 extend outwardly from inside shaft 26 and resiliently engage the concavities 23, 25 as urged by spring 36 so that the spindle 14 suspends the cover 10 and roll 15 from the wall bracket 12. The spring force exerted by spring 36 maintains the buttons 32, 34 in a secure engagement with the spindle 14. The leading end 17 of the paper web product 11 may be threaded through the longitudinal slot 58 either before installation on the wall bracket 12 or after installation by extending one or more fingers through slot 58 to grasp the end and thread the end through slot 58.

When installed on the wall bracket 12, a portion of the curved interior surface 50 of the cover 10 contacts an upper curved surface 15*a* of the roll 15 and rests on the roll 15, as shown in FIGS. 2 and 3. Pulling on the leading end 17 of the paper web product 11 unrolls the product 11 from the roll 15 and thereby dispenses lengths of the paper web product 11 for use. The tubular sidewall 42 may rotate for a short angular distance when a user pulls on the leading end 17 of the paper web product 11 and the roll 15 rotates on spindle 14 during dispensing. However, the slight rotation of the cover 10 is limited. If the paper web product 11 breaks such that the end is hidden inside the sidewall 42, the user may easily reach through the slot 58 with one or more fingers to re-thread the end 17 through the slot 58. During use, the cover 10 at least partially conceals the paper web product 11 on roll 15. Preferably, the cover 10 fully conceals the roll 15.

Figure 3A:
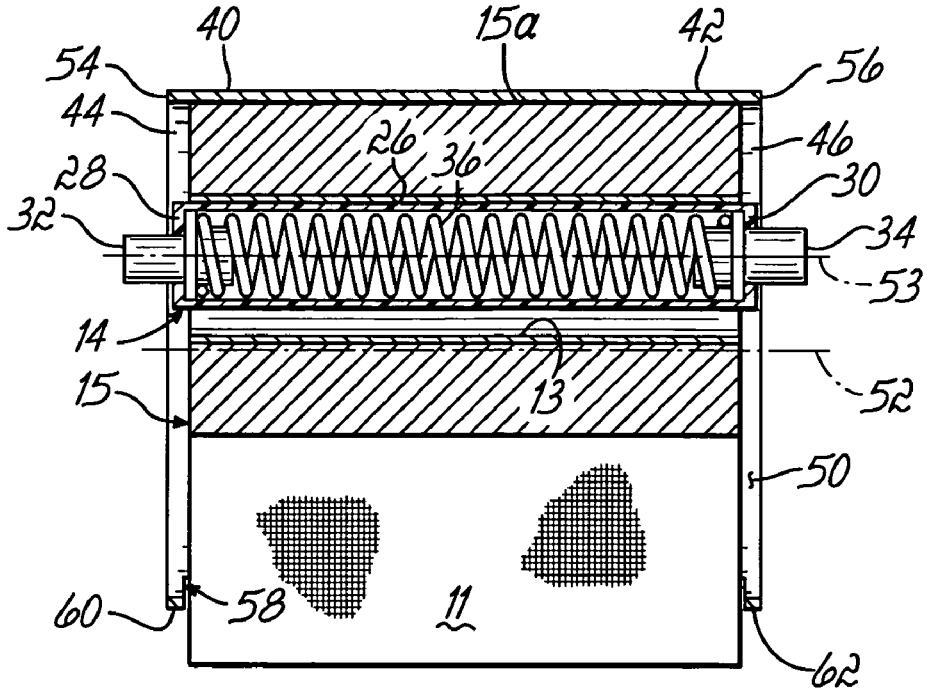
FIG. 3A is a longitudinal cross-sectional view similar to FIG. 3 in which the paper web product carried by the roll has been partially used.

As the paper web product 11 is used, the outer diameter of the roll 15 diminishes, as suggested in FIG. 3A in which the paper web product 11 has been partially removed from the roll 15 and used. However, the portion of the curved interior surface 50 of the cover 10 continues to contact an upper curved surface 15*a* of the roll 15 and rests on the roll 15. The force of gravity operates to maintain the contact, even when the roll 15 is rotating and being unwound by the user to dispense the paper web product 11.

Figure 4:
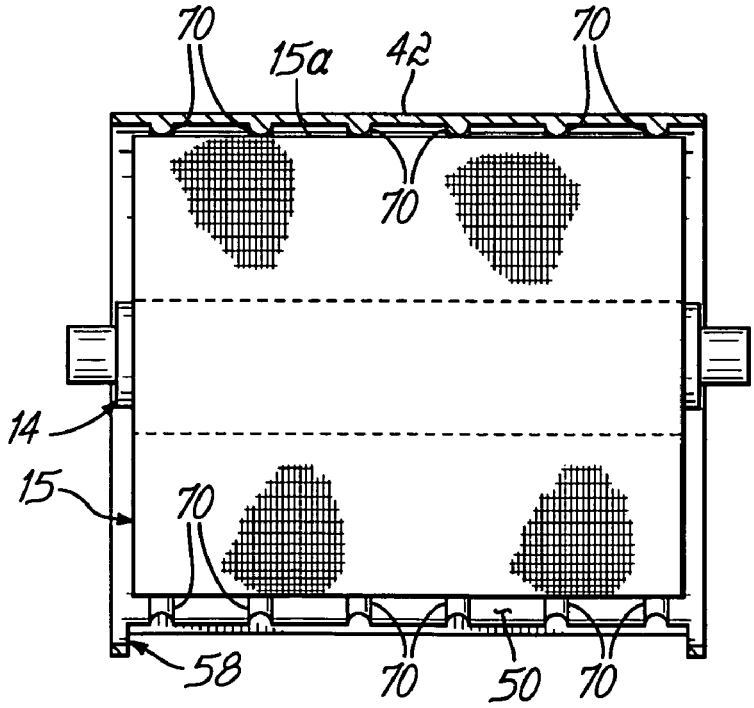
FIG. 4 is a partial longitudinal, cross-sectional view similar to FIG. 3 of a cover in accordance with an alternative embodiment of the invention.

With reference to FIG. 4 and in accordance with an alternative embodiment of the invention, the tubular shell 40 may be modified to optionally include a set of ribs 70 extending circumferentially about at least a portion of the curved interior surface 50 of the tubular sidewall 42. The ribs 70, which project radially inwardly from interior surface 50 into the cavity 48 toward longitudinal axis 52, are positioned on the tubular sidewall 42 to contact the upper curved surface 15*a* of the roll 15. This advantageously reduces the contact area between the paper web product 11 on the roll 15 and the tubular shell 40, which may be advantageous during dispensing.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. For example, the cover of the invention may be used to cover a roll of different types of paper web products, such as paper towels, suspended on a spindle carried by a wall-mounted or surface mounted bracket.

The invention itself should only be defined by the appended claims, wherein I claim:

1. A cover for a roll of a paper web product, the roll having an upper curved surface, the cover comprising:

a shell having a tubular sidewall extending between a first open end surrounded by a first rim and a second open end surrounded by a second rim, each of said first and second open ends being unoccluded for moving the roll of the paper web product into an at least partially concealed position inside said tubular sidewall, and said tubular sidewall having an interior surface configured to continuously contact the upper curved surface of the roll as the roll is unwound; and a longitudinal slot defined in said tubular sidewall and extending generally between said first and second open ends, said longitudinal slot for accessing the at least partially concealed position inside said tubular sidewall, said longitudinal slot bounded by a first edge and a second edge, said first edge being separated from said first rim by a first portion of said tubular sidewall, and said second edge being separated from said second rim by a second portion of said tubular sidewall.

2. The cover of claim 1 wherein said tubular sidewall is cylindrical and has a diameter greater than a diameter of the roll of the paper web product.

3. The cover of claim 1 wherein said longitudinal slot extends for a distance at least equal to a width of the paper web product.

4. The cover of claim 1 wherein said longitudinal slot is arcuate and substantially rectangular.

5. The cover of claim 4 wherein said longitudinal slot has a first dimension measured in a circumferential direction equal to about 2 inches and a second dimension measured in a direction between said first and second edges equal to about 4½ inches.

6. The cover of claim 4 wherein said tubular sidewall is annular, and said tubular sidewall has a first dimension between said first and second rims equal to about 5½ inches and at least one of said first and said second rims has a diameter equal to about 4¾ inches.

7. The cover of claim 1 wherein said cover is free of moving mechanical components.

8. The cover of claim 1 wherein said tubular sidewall contacts the roll when the roll is in the at least partially concealed position inside said tubular sidewall.

9. The cover of claim 1 further comprising:

a plurality of circumferential ribs projecting inwardly from said tubular sidewall, said circumferential ribs contacting the roll for spacing said tubular sidewall from the roll.

10. The cover of claim 1 wherein said tubular shell fully conceals the roll when the roll is located in the at least partially concealed position inside said sidewall.

11. The cover of claim 1 wherein said tubular shell comprises an opaque polymer.

12. The cover of claim 1 wherein said open ends are dimensioned and shaped geometrically for inserting the roll to the at least partially concealed position inside said sidewall.

13. The cover of claim 1 wherein said first portion of said tubular sidewall is a first strip of a material constituting said tubular sidewall and said second portion of said tubular sidewall is a second strip of said material constituting said tubular sidewall.

14. The cover of claim 1 wherein said tubular sidewall has an interior surface facing the roll of the paper web product and an exterior surface opposite to said interior surface, said longitudinal slot extending between said interior and exterior surfaces.

15. The cover of claim 14 further comprising:

a surface finish on the exterior surface.

16. The cover of claim 1 wherein said tubular sidewall is annular with a curved interior surface and a curved exterior surface, said longitudinal slot extending between said curved interior and exterior surfaces.

17. A cover for a roll of a paper web product, the roll supported on a spindle, the cover comprising:

a shell having a tubular sidewall extending between a first open end surrounded by a first rim and a second open end surrounded by a second rim, each of said first and second open ends being unoccluded for moving the roll of the paper web product into an at least partially concealed position inside said tubular sidewall, and said tubular sidewall contacting the roll such that said shell is supported by the spindle as the roll is unwound; and a longitudinal slot defined in said tubular sidewall and extending generally between said first and second open ends, said longitudinal slot for accessing the at least partially concealed position inside said tubular sidewall, said longitudinal slot bounded by a first edge and a second edge, said first edge being separated from said first rim by a first portion of said tubular sidewall, and said second edge being separated from said second rim by a second portion of said tubular sidewall.

18. A cover for a roll of a paper web product, the roll supported on a spindle coupled with a wall bracket, the cover comprising:

a shell having a tubular sidewall extending between a first open end surrounded by a first rim and a second open end surrounded by a second rim, each of said first and second open ends being unoccluded for moving the roll of the paper web product into an at least partially concealed position inside said tubular sidewall, and said tubular sidewall contacting the roll such that said shell is suspended by the spindle from the wall bracket as the roll is unwound; and a longitudinal slot defined in said tubular sidewall and extending generally between said first and second open ends, said longitudinal slot for accessing the at least partially concealed position inside said tubular sidewall, said longitudinal slot bounded by a first edge and a second edge, said first edge being separated from said first rim by a first portion of said tubular sidewall, and said second edge being separated from said second rim by a second portion of said tubular sidewall.

* * * * *